US006575882B2

(12) United States Patent
Chen

(10) Patent No.: US 6,575,882 B2
(45) Date of Patent: Jun. 10, 2003

(54) EXERCISE DEVICE HAVING WEIGHTS AND SAFETY MECHANISM TO MAINTAIN WEIGHTS IN PLACE

(76) Inventor: James Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 63 days.

(21) Appl. No.: 09/791,784

(22) Filed: Feb. 26, 2001

(65) Prior Publication Data

US 2002/0119870 A1 Aug. 29, 2002

(51) Int. Cl.[7] ..... A63B 21/062
(52) U.S. Cl. ..... 482/98; 482/99
(58) Field of Search ..... 482/98, 99, 101–103, 482/93, 94

(56) References Cited

U.S. PATENT DOCUMENTS 4,601,466 A * 7/1986 Lais ..... 272/118
4,614,338 A * 9/1986 Castillo ..... 272/117
5,135,451 A * 8/1992 Chen ..... 482/98
6,126,579 A * 10/2000 Lin ..... 482/98
6,174,265 B1 * 1/2001 Alessandri ..... 482/5
6,193,635 B1 * 2/2001 Webber et al. ..... 482/98
D462,729 S * 9/2002 Lawson ..... D21/680

* cited by examiner

*Primary Examiner*—Nicholas D. Lucchesi
*Assistant Examiner*—Tam Nguyen
(74) *Attorney, Agent, or Firm*—Browdy and Neimark, P.L.L.C.

(57) ABSTRACT

An exercise device comprises a load mechanism which is formed of at least one guide rod, a plurality of weights, and an adjustment rod. Each weight has at least one round hole, a through hole, an insertion slot extending from the round hole, and an elastic clamp disposed removably in the round hole and the insertion slot. The guide rod is inserted into the round hole via the insertion slot. The adjustment rod is disposed in the trough hole of the weight and is provided with a plurality of locating holes for locating an insertion pin which is used to urge a selected weight. The elastic clamp is a safety feature to prevent slippage of the weight.

3 Claims, 4 Drawing Sheets

EXERCISE DEVICE HAVING WEIGHTS AND SAFETY MECHANISM TO MAINTAIN WEIGHTS IN PLACE

FIELD OF THE INVENTION

The present invention relates generally to an exercise device, and more particularly to a load mechanism of the exercise device.

BACKGROUND OF THE INVENTION

As shown in FIG. 1, a prior art exercise device 10 comprises two guide rods 12 which are received in the through holes of a carrying board 14. The carrying board 14 is provided with an inclined top and is provided in the middle with a pull cord. A plurality of weights 16 are disposed on the carrying board. The weights 16 have two insertion slot 17 for receiving the guide rods. The insertion slots are provided in two sides of the bottom thereof with two plastic projection for preventing the escape of the guide rods. These plastic projections are seen, for example, as projections 321 in FIGS. 2 and 3 of Lin U.S. Pat. No. 6,126,579. Located between the two insertion slots is a through slot 18 for receiving the pull cord. The plastic projections of the weights are prone to wear, thereby causing the weights to be insecurely superimposed. As a result, the weights become a safety problem of the prior art exercise device.

SUMMARY OF THE INVENTION

The primary objective of the present invention is to provide an exercise machine with a plurality of weights which are easy assembly and safety from the shortcomings of the prior art weights described above.

The weights of the present invention are provided with a plurality of holes, any one of which extends into an insertion slot for allowing a guide rod to be held in the round hole. An elastic clamp is disposed in the round hole and the insertion slot for sealing off the open end of the insertion slot. An adjustment rod is received in other hole of the weights and is provided with a plurality of locating holes for receiving an insertion pin to urge a selected weight. The weights are securely held.

DETAILED DESCRIPTION OF THE INVENTION

Figure 1:
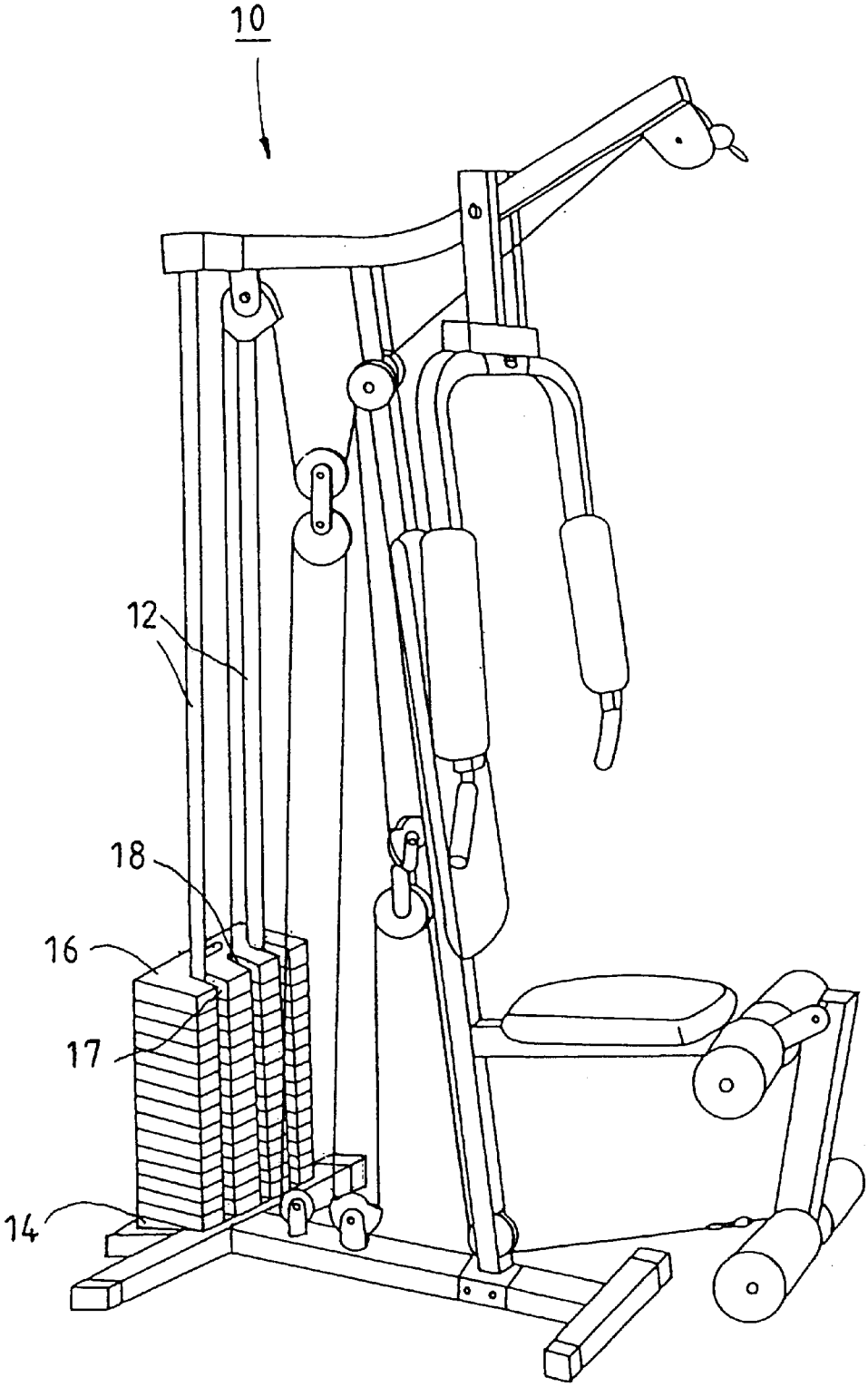
FIG. 1 PRIOR ART
FIG. 1 shows a perspective view of an exercise device of the prior art.
Figure 2:
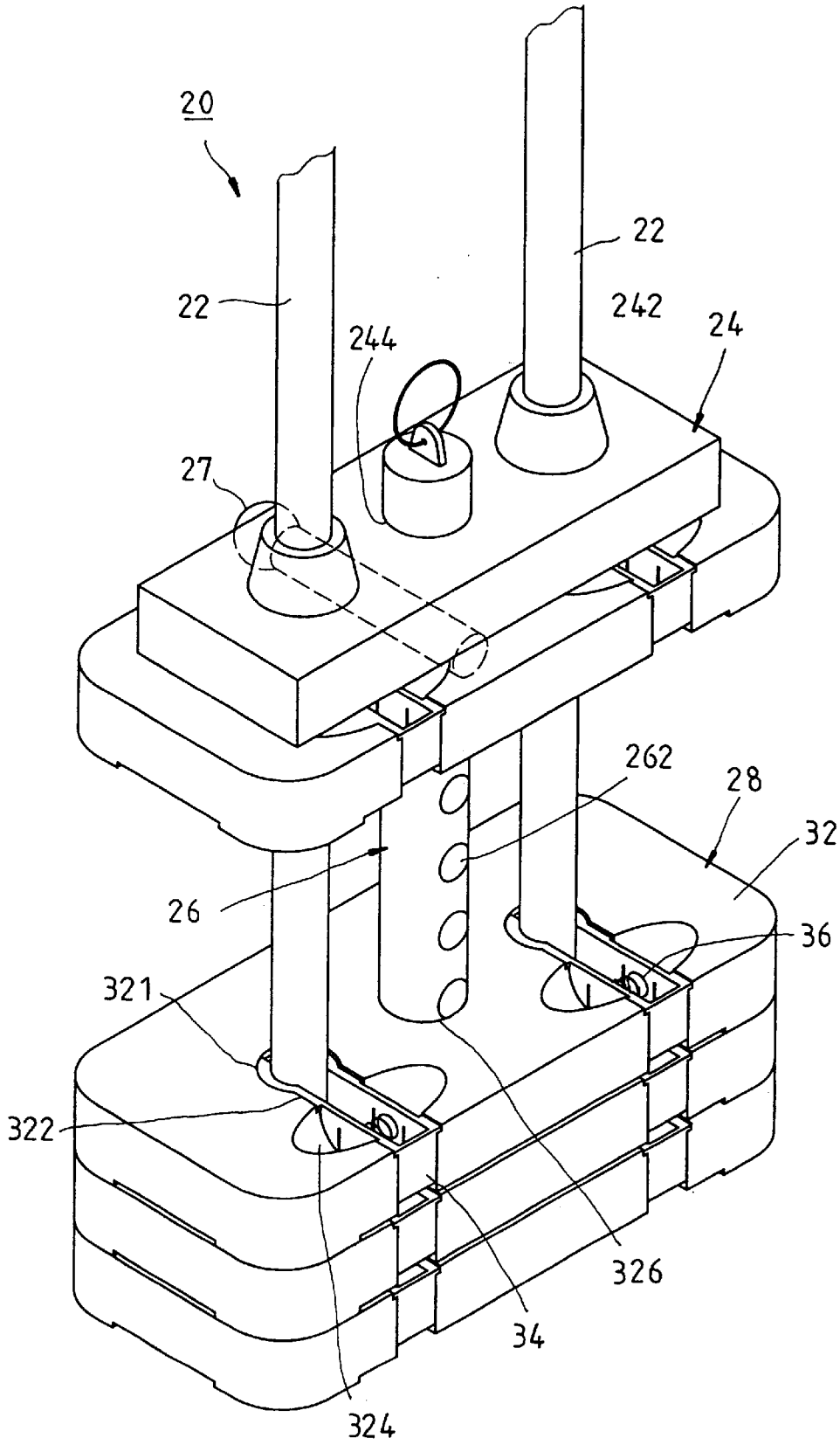
FIG. 2 shows an exploded view of a weight of the load mechanism of the present invention.
Figure 3:
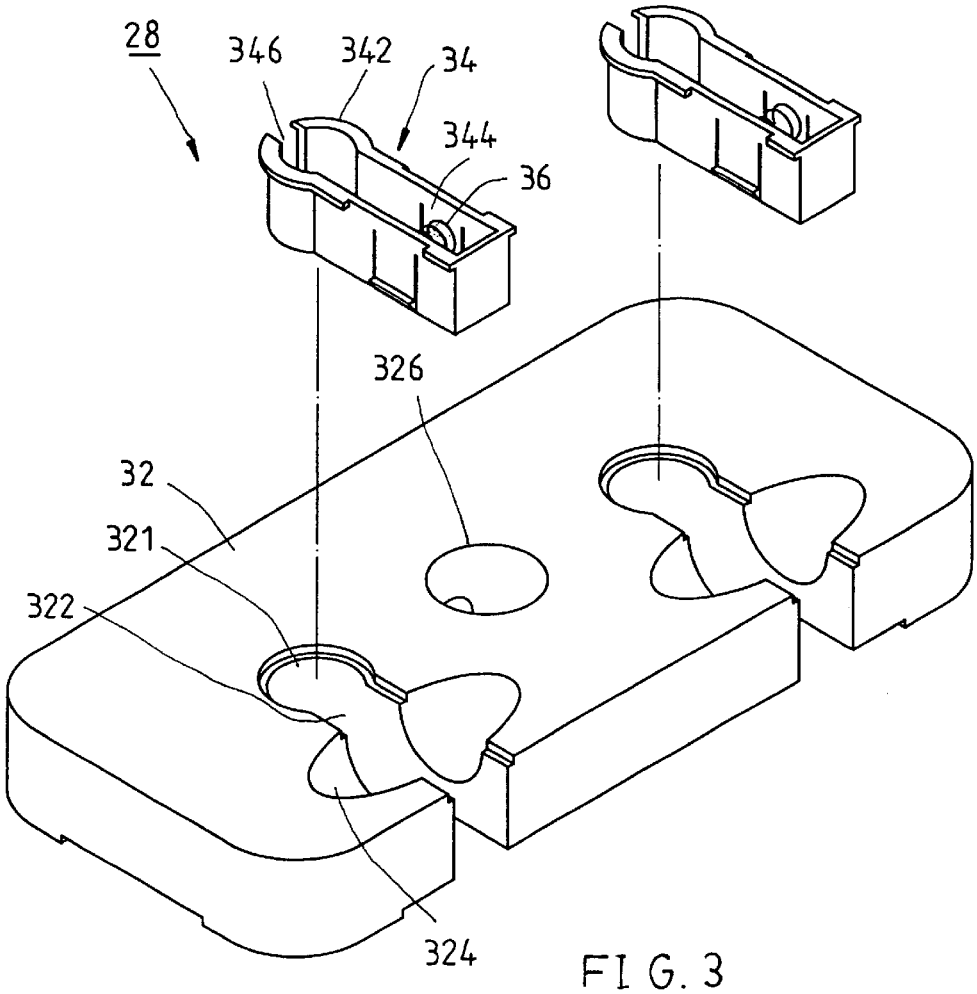
FIG. 3 shows an exploded view of a weight of the load mechanism of the present invention.
Figure 4:
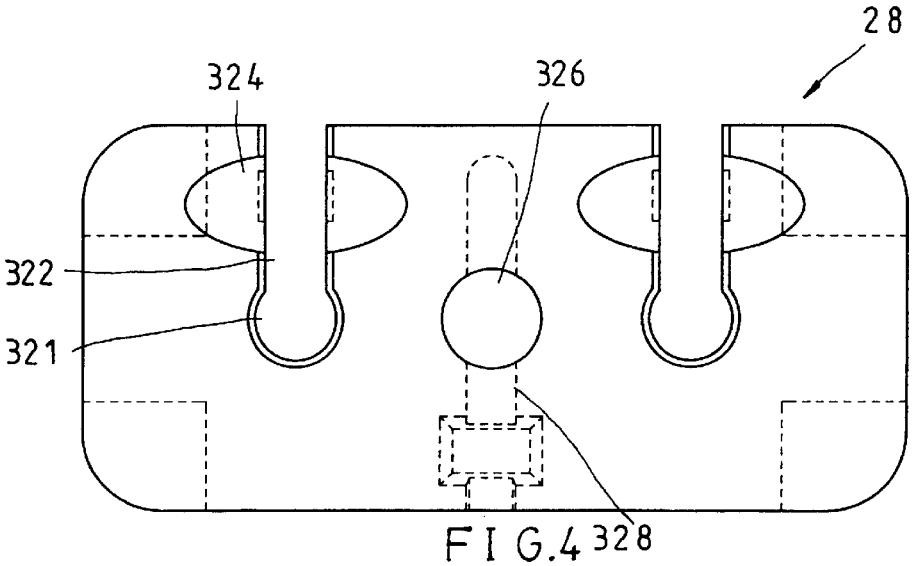
FIG. 4 shows a plan view of the weight main body of the present invention.
Figure 5:
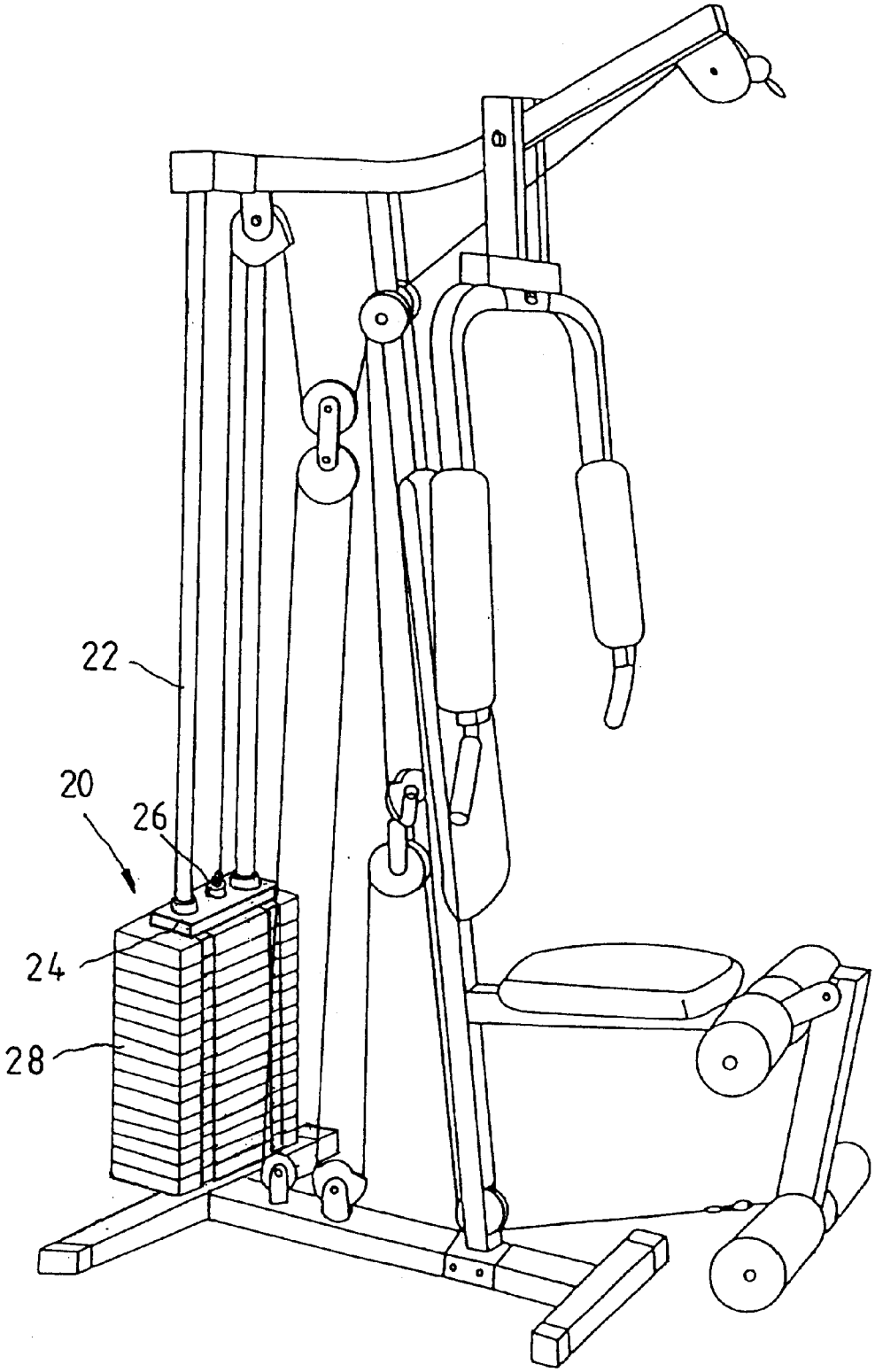
FIG. 5 shows a perspective view of a preferred embodiment of the present invention.

As shown in FIGS. 2–5, the weights of the present invention are held on a load mechanism of the exercise device of the present invention. The support frame, the action mechanism, the transmission mechanism, and the seat unit of the exercise device are not subject matters of the present invention.

The load mechanism 20 of the present invention is mounted on the support frame and is formed of two guide rods 22, a press board 24, an adjustment rod 26, and a plurality of weights 28.

The two guide rods 22 extend upright from the bottom of the load mechanism 20 such that they are parallel to each other.

The press board 24 is provided with two through holes 242 for receiving the two guide rods 22 such that the two guide rods 22 can be moved up and down, and a through hole 244 located between the two through holes 242.

The adjustment rod 26 is received in the third through hole 244 and is provided in the periphery with a plurality of locating holes 262 which are arranged at an interval for receiving an insertion pin 27. The insertion pin 27 is used to urge a selected weight 28. The adjustment rod 26 is provided at the top end with a pull cord for transmitting the load to other mechanisms of the exercise device.

The weights 28 are disposed under the press board 24 and are formed of a main body 32 which is provided with two round holes 321 corresponding to each other. An insertion slot 322 is extended from the peripheral edge of each round hole 321. The guide rod 22 is inserted into the round hole 321 via the insertion slot 322. The insertion slot 322 is provided in two sides with an arcuate slot 324 of a predetermined depth. A through hole 326 is located between the two round holes 321 for receiving the adjustment rod 26. The main body 32 is provided at the bottom with a long slot 328 to facilitate the urging by the insertion pin 27. Two elastic clamps 34 are disposed respectively in the round hole and the insertion slot 322. The elastic clamps 34 are made integrally and are formed of a hollow head 342 and a body 344. The head 342 is provided at the front end with an opening 346. The body 344 is provided with a spring 36 serving to provide the elastic clamp 34 with an outward tension. In combination, the head 342 is retained on the guide rod 22 such that the body 344 is inserted into the insertion slot 322 of the weight 28.

The weight 32 is inserted between the two guide rods 22 along the insertion slots 322 such that the elastic clamp 34 is disposed in the round hole 321 and the insertion slot 322 of the weight 32. The adjustment rod 26 is then inserted into the through hole 326 of the weight 32 via the through hole 244 of the press board 24. The insertion pin 27 is inserted into any one of the locating holes 262 of the adjustment rod 26 for selecting a desired load. The weight is removed by fingers which press two sides of the elastic clamp 34 along the arcuate slot 324. The elastic clamp 34 is moved upward along the guide rod 22. The weights are then removed one after another with ease. The weights of the present invention are securely held to prevent the fall of the weights at the time when the exercise device is moved.

What is claimed is:

1. An exercise device comprising a support frame and a load mechanism mounted on the support frame, said load mechanism comprising:

at least one guide rod extending upward from a bottom of said load mechanism;

a plurality of weights, with each having at least one round hole, a through hole, and an insertion slot extending from said round hole to enable said guide rod to be inserted into said round hole via said insertion slot, said round hole and said insertion slot being provided with an elastic clamp for sealing off an open end of said insertion slot; and an adjustment rod disposed in said through hole of said weight and provided in periphery of said rod with a plurality of locating holes for locating an insertion pin which is used to urge a selected weight.

2. The exercise device as defined in claim 1, wherein said insertion slot is provided in two sides with an arcuate slot of a predetermined depth to facilitate fingers to press against two sides of said elastic clamp so as to remove said elastic clamp from said weight.

3. The exercise device as defined in claim 1, wherein said elastic clamp is formed integrally of a head and a body, said head being hollow and having an opening, said body being provided with a spring serving to provide said elastic clamp with an outward tension.

* * * * *